US006192793B1

(12) United States Patent
Motoe et al.

(10) Patent No.: US 6,192,793 B1
(45) Date of Patent: Feb. 27, 2001

(54) DRUM TYPE PRINTER HAVING MECHANISM FOR ADJUSTING TRANSVERSE POSITION OF PRINTED IMAGE

(75) Inventors: Katsuro Motoe; Hiroyasu Kato, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/471,388

(22) Filed: Dec. 23, 1999

(30) Foreign Application Priority Data

Jan. 5, 1999 (JP) ..... 11-000676

(51) Int. Cl.[7] ..... B41F 15/38

(52) U.S. Cl. ..... 101/116; 101/248; 101/DIG. 36

(58) Field of Search ..... 101/114, 116, 101/117, 118, 119, 120, 129, 248, 481, 485, 486, DIG. 36

(56) References Cited

U.S. PATENT DOCUMENTS 3,572,240 * 3/1971 Bohm ..... 101/116
4,911,069 3/1990 Hayama et al. .
5,507,225 * 4/1996 Noguchi et al. ..... 101/116

FOREIGN PATENT DOCUMENTS 62-28757 6/1987 (JP) .
1-204781 8/1989 (JP) .
5-330224 12/1993 (JP) .
6-71998 3/1994 (JP) .
7-137418 5/1995 (JP) .
2542489 7/1996 (JP) .
9-1913 1/1997 (JP) .
9-104159 4/1997 (JP) .

* cited by examiner

*Primary Examiner*—Ren Yan
(74) *Attorney, Agent, or Firm*—Oliff & Berridge, PLC

(57) ABSTRACT

A printing drum (12) is supported by a first frame (36) to be rotatable around its central axis (38). The first frame (36) is supported by a second frame (52) to be movable relative to the second frame (52) along the central axis (38) for at least a distance corresponding to a maximum value of an adjustment of a transverse position of a printed image. The second frame (52) is removably mounted to a machine frame (10), wherein the first frame (36) is moved relative to the second frame (52) only for a distance required for an adjustment of a transverse position of a printed image.

9 Claims, 5 Drawing Sheets

DRUM TYPE PRINTER HAVING MECHANISM FOR ADJUSTING TRANSVERSE POSITION OF PRINTED IMAGE

BACKGROUND OF THE INVENTION

1. Field of the Invention

The present invention relates to a drum type printer, and more particularly, to a drum type printer having a mechanism for adjusting a transverse position of a printed image.

2. Description of the Prior Art

In Japanese Patent Publication No. 2542489 issued Oct. 9, 1996, there is described a device for adjusting a transverse position of a printed image for a stencil printer having a drum unit rotatably supporting a cylindrical printing drum and slidably mounted in a body of the printer along the longitudinal axis of the printing drum, so as to be manually dismountable out of the printer body at the end of the sliding drawout movement, wherein the printed image transverse position adjustment device comprises guide means provided in the printer body for guiding the drum unit in the sliding direction, a movement transmission system for moving the drum unit in the sliding direction along the guide means for a minute distance, a motor for driving the movement transmission system, and clutch means for optionally connecting or disconnecting the movement transmission system to or from the drum unit.

In the printed image transverse position adjustment device for a stencil printer described in the above-mentioned patent publication, the drum unit is slid as a whole for an adjustment of a transverse position of a printed image along the guide means for dismountably mounting the drum unit in the printer body.

The drum unit of this type, when it is the drum unit of a stencil printer, incorporates therein an ink container to serve as a source of a printing ink and an ink pump for transporting the ink from the ink container to the inside of the printing drum, so that the weight of the drum unit as a whole is substantial such as about 10 kg or more. Further, such a drum unit has a length such as about 40 cm or more and a diameter such as about 20 cm. Therefore, for the drum unit of such weight and size to be inserted into a drum unit bore of the printer body or drawn out of the drum unit bore by the hands of a man or woman, what is required for the guide means for guiding the drum unit relative to the printer body for the insertion and the drawout thereof into and out of the printer body is a strength rather than a fineness.

On the other hand, an adjustment of a transverse position of a printed image provided on a print sheet is of the order of 10 mm at the largest, and often requires a fineness smaller than 1 mm, so as to be more desirable as the fineness is higher.

In view of the above points, it will not be rational to conduct such an adjustment of a transverse position of a printed image that is in a range of 10 mm at the largest and is more desirable when it is more fine, by such macro-structural guide means for guiding the drum unit, a heavy article, over a guide distance extending so long as about 40 cm for the insertion and the drawout thereof into and out of the printer body.

SUMMARY OF THE INVENTION

In view of the above matters, it is a primary object of the present invention to provide a drum type printer equipped with a device for adjusting a transverse position of a printed image suitable for the purpose of adjusting a transverse position of a printed image and the performance required therefor.

According to the present invention, the above-mentioned primary object is accomplished by a drum type printer comprising:

a machine frame;

a printing drum;

a back press roller rotatably mounted in the machine frame for selectively pressing a print sheet to the printing drum;

first frame means for supporting the printing drum to be rotatable around a central axis thereof; and second frame means for supporting the first frame means to be movable along the central axis of the printing drum for at least a distance corresponding to a maximum value of an adjustment of a transverse position of a printed image;

the machine frame having means adapted to removably engage a part of the second frame means for supporting and guiding the second frame means, so as to drawably receive the second frame means, the first frame means supported by the second frame means and the printing drum supported by the first frame means; and actuation means for adjusting a transverse position of a printed image, the printed image transverse position adjustment actuation means being adapted to selectively move the first frame means relative to the machine frame when the second frame means are mounted in the machine frame.

According to the above-mentioned construction of the drum type printer, an adjustment of a transverse position of a printed image is available by the first frame means rotatably supporting the printing drum is made movable relative to the second frame means along the central axis of the printing drum within a distance corresponding to the maximum value of the printed image transverse position adjustment, so that the construction for movably supporting the first frame means relative to the second frame means can be made optionally fine and high precision as required, regardless of the easiness and toughness for the handling of the second frame means in the mounting and dismounting thereof relative to the machine frame.

In more detail, the printed image transverse position adjustment actuation means may be adapted to act between the first frame means and the machine frame.

In such a construction that the printed image transverse position adjustment actuation means act between the first frame means and the machine frame, the printed image transverse position adjustment actuation means may comprise a shaft portion provided in the first frame means to extend in a direction of extension of the central axis of the printing drum, a shift block supported and guided by the machine frame to be movable along the direction of extension of the central axis of the printing drum and having a bore for selectively receiving the shaft portion of the first frame means, drive source means for selectively driving the shift block along the movable direction thereof, and means for selectively holding the shaft portion of the first frame means in the bore of the shift block when the shaft portion was inserted in the bore.

Or, alternatively, the printed image transverse position adjustment actuation means may be adapted to act between the first frame means and the second frame means.

In both of the construction that the printed image transverse position adjustment actuation means act between the first frame means and the machine frame and the construction that the printed image transverse position adjustment actuation means act between the first frame means and the second frame means, the printed image transverse position adjustment actuation means may comprise a screw portion provided in the first frame means to extend in the direction of extension of the central axis of the printing drum, a nut member having a tapped bore and mounted on the second frame means to be rotatable around a central axis of the tapped bore, and drive source means for selectively rotating the nut member.

In such a construction, the nut member may be stationarily positioned relative to the second frame means with respect to an axial position thereof, or the nut member may be stationarily positioned relative to the machine frame with respect to an axial position thereof when the second frame means have been mounted in the machine frame.

In both of such constructions, the printing drum may have a bearing bore aligned with the central axis thereof at a first end thereof and an annular track along an inner periphery of a second end thereof opposite to the first end thereof, the first frame means having a first shaft portion at a first end thereof, the first shaft portion extending along the central axis of the printing drum while engaging the bearing bore of the printing drum therethrough so as to rotatably support the first end of the printing drum, second and third shaft portions at a second end thereof opposite to the first end thereof, the second and third shaft portions extending in parallel with the central axis of the printing drum, and at least three rollers engaging the annular track for rotatably supporting the second end of the printing drum, and the second frame means having a first slide guide bore at a first end thereof for receiving the first shaft portion of the first frame means to be slidable along the central axis of the printing drum, and second and third slide guide bores at a second end thereof opposite to the first end thereof for receiving the second and the third shaft portions of the first frame means, respectively, to be slidable in parallel with the central axis of the printing drum.

In such a construction, the first frame means may be elastically biased by spring means relative to the second frame means in a direction of moving from the second end to the first end of the second frame means, and the printed image transverse position adjustment actuation means may include means for acting at the first shaft portion of the first frame means so as to restrict an axial movement of the first frame means biased by the spring means.

BRIEF DESCRIPTION OF THE DRAWINGS

In the accompanying drawings.

DESCRIPTION OF THE EMBODIMENTS

Figure 1:
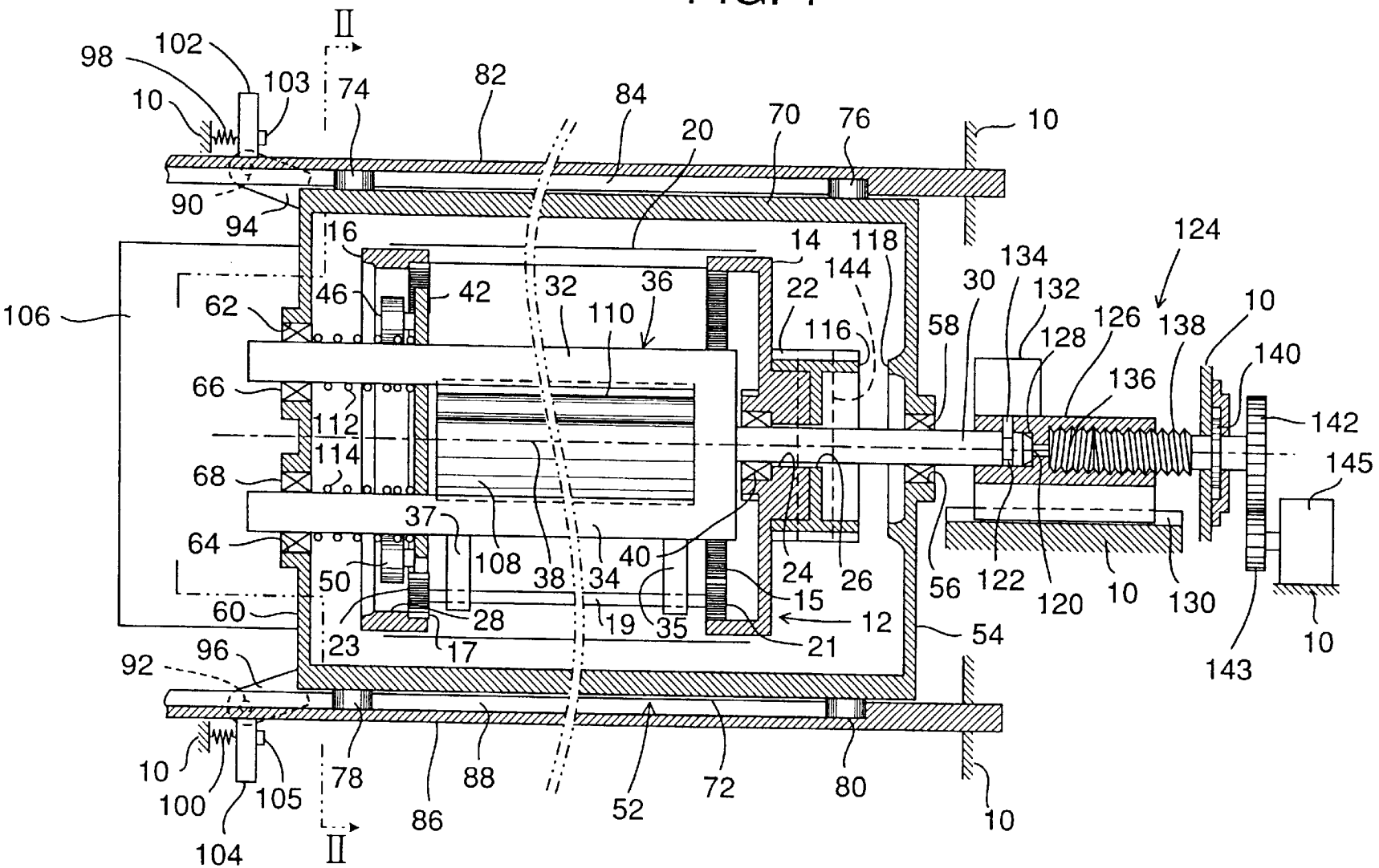
FIG. 1 is a diagrammatical plan view showing a first embodiment of the drum type printer having a mechanism for adjusting a transverse position of a printed image according to the present invention embodied as a stencil printer.
Figure 2:
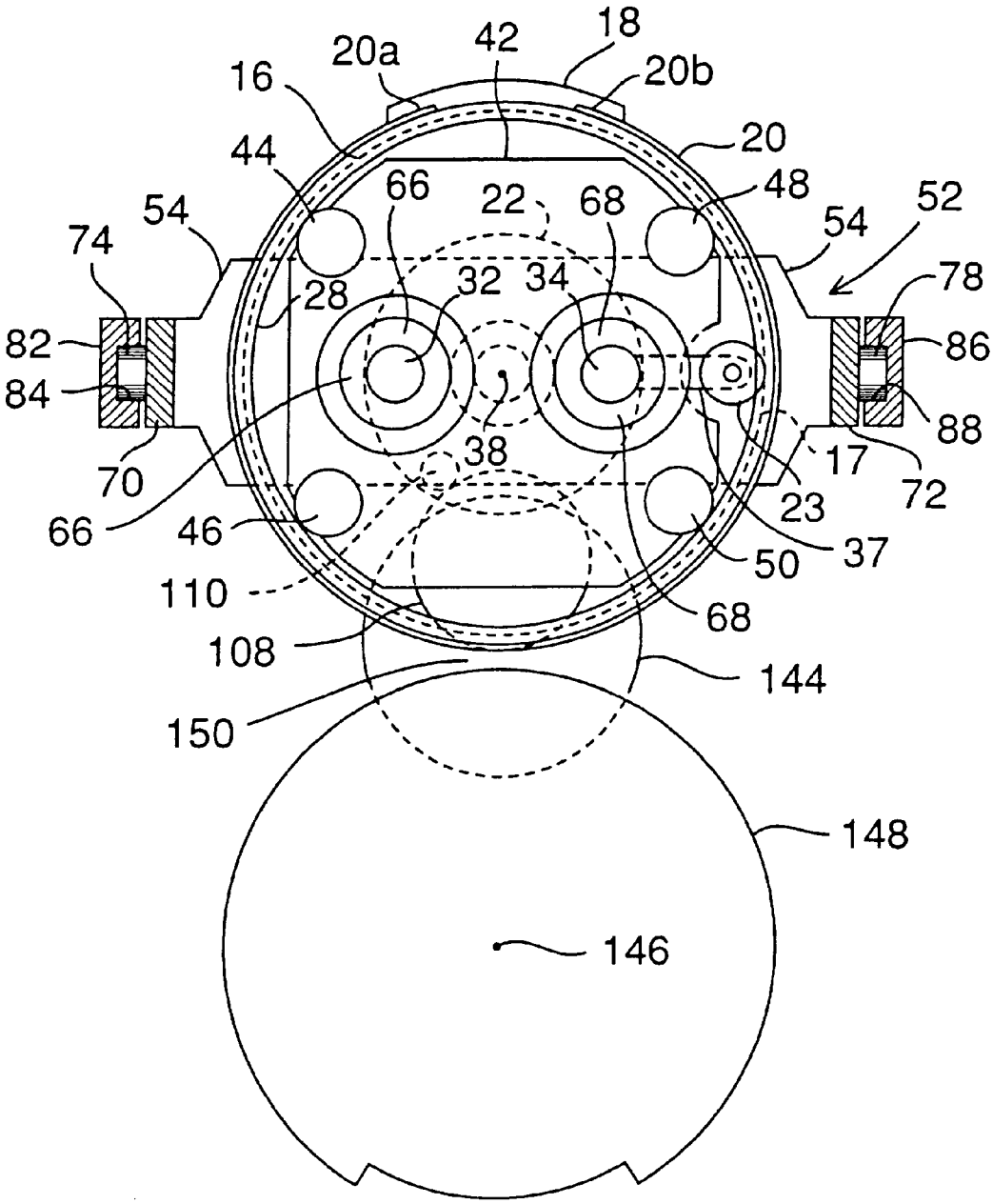
FIG. 2 is a diagrammatical sectional view of the printer of FIG. 1 taken along section II—II in FIG. 1.

Referring to FIGS. 1 and 2, reference numeral 10 designates a part of the machine frame providing a so called housing of the printer, and therefore, these portions are all stationary portions with regard to a movement of the printing drum described hereinbelow.

A printing drum generally designated by 12 has a rigid dish-like member 14 forming a first end thereof, a rigid annular member 16 forming a second end thereof opposite to the first end, a rigid transverse bridge member 18 (FIG. 2) extended between the members 14 and 16 and firmly connecting these two members, and a perforated sheet 20 having a rectangular shape in development and rolled in a cylindrical shape with opposite edges thereof being laid around the outer peripheral surfaces of the dish-like member 14 and the annular member 16. Although not shown in detail in the figures, a leading end portion 20*a* of the perforated sheet 20 as viewed in the peripheral direction of the printing drum is fixed to a side edge portion of the transverse bridge member 18 therealong, while a trailing edge portion 20*b* of the perforated sheet is held by the transverse bridge member 18 along the other side edge portion thereof to be movable relative thereto in the peripheral direction. A gear wheel member 22 having gears therearound is fixed to the dish-like member 14. Bores 24 and 26 are formed through the dish-like member 14 and the gear wheel member 22 in alignment along the central axes thereof so as to provide a through bore in the first end of the printing drum along the central axis thereof. The annular member 16 is formed with an annular track 28 having a smooth surface along an inner peripheral surface thereof.

The printing drum 12 is supported by first frame means 36 to be rotatable about the central axis 38. The first frame means 36 has a first shaft portion 30 passed through the central bore 24 of the dish-like member 14 and the central bore 26 of the gear wheel member 22, and second and third shaft portions 32 and 34 branched from a root portion of the first shaft portion so as to extend out of the printing drum through the annular member 16. The printing drum is rotatably supported at the dish-like member 14 from the first shaft portion 30 via a radial/thrust bearing 40 against radial and thrust movements and also at the annular member 16 from the second and third shaft portions 32 and 34 via an end plate 42 fixed to the second and third shaft portions and four rollers 44, 46, 48 and 50 rotatably mounted to the end plate 42 so as to engage and roll along the annular track 28 of the annular member 16.

The dish-like member 14 and the annular member 16 are formed with annular gears 15 and 17 along their inner peripheral surfaces of their axially opposing inside edges, respectively. Pinions 21 and 23 connected with one another by a shaft 19 mesh with the annular gears 15 and 17, respectively. The shaft 19 is rotatably supported from the third shaft portion via arms 35 and 37. By such an arrangement, a rotational power transmitted to the dish-like member 14 from the gear wheel member 22 as described in detail hereinbelow is further transmitted from the annular gear 15 through the pinion 21, the shaft 19, the pinion 23 and the annular gear 17 to the annular member 16, so that the printing drum 12 constructed by the dish-like member 14, the annular member 16, the transverse bridge member 18 and the perforated sheet 20 is rotated by the rotational power supplied to the gear wheel member 22 without causing a twisting.

The first frame means 36 are supported by second frame means 52 so as to be movable along the central axis 38 as much as a distance corresponding to a maximum value for an adjustment of a transverse position of a printed image.

The second frame means 52 have a frame body of a rectangular shape as shown in FIG. 1. An end portion 54 of the frame body along the central axis 38 has a bore 56 for passing the first shaft portion 30 of the first frame means and supports at the bore 56 the first shaft portion 30 via slide guide element 58 so as to be movable along the central axis 38. Another edge portion 60 of the second frame means 52 has bores 62 and 54 at positions for passing the second and third shaft portions 32 and 34 of the first frame means 36 and supports at these bore portions the second and third shaft portions 32 and 34 via slide guide elements 66 and 68, respectively, so as to be movable in parallels with the central axis 38.

Opposite side edge portions 70 and 72 of the second frame means 52 bear rollers 74, 76, 78 and 80 so as to be rotatable around respective central axes. The rollers 74 and 76 are engaged in a longitudinal groove 84 of a guide rail member 82 fixed to the machine frame 10. Similarly, the rollers 78 and 80 mounted to a side edge portion 72 are engaged in a longitudinal groove 88 of a guide rail member 86 fixed to the machine frame 10. By these rollers 74–80 rolling along the corresponding longitudinal grooves 84 and 88 of the rail members 82 and 86, the second frame means 52 are movable along the central axis 38 between a final mount position in the machine frame such as shown in FIG. 1 and a drawout position moved leftward in FIG. 1 relative to the machine frame.

The mounting state of the second frame means 52 to the mount position shown in FIG. 1 along the guide members 82 and 86 is held by lock members 94 and 96 pivotably supported from the machine frame 10 via pivot shafts 90 and 92 to be pivotable therearound engaging opposite edge portions of the end portion 60 of the second frame means under a biasing applied by springs 98 and 100, respectively. The lock members 94 and 96 are releasable from the engagement with the second frame means 52 by their lever portions 102 and 104 being turned around the pivot shafts 90 and 92 against the spring forces of the springs 98 and 100, respectively.

A tray member diagrammatically shown by 106 is integrally mounted to the second frame means 52 for supporting an ink container and an ink pump not shown in the figure. Further, in the inside of the printing drum 12, an inking roller 108 is mounted to the first frame means 36 to be rotatable around its central axis by bearing means not shown in the figure, and is adapted to be driven to rotate around the central axis thereof in synchronization with a rotation of the printing drum 12 by drive force transmission means not shown in the figure. Further, a doctor rod 110 is mounted as supported from the first frame means 36 by mounting means not shown in the figure.

The first frame means 36 are elastically biased to move rightward in FIG. 1 relative to the second frame means 52 by compression coil springs 112 and 114 mounted around the second and third shaft portions 32 and 34, respectively, to act between the end plate 42 and the end portion 60 of the second frame means, so that unless the first shaft portion 30 engages print image transverse position adjustment actuation means at its tip portion as described hereinbelow, the first frame means 36 are moved rightward in FIG. 1 relative to the second frame means 52 until an annular end surface 116 of the gear wheel member 22 mounted at the first end of the printing drum 12 abuts against an annular rib portion 118 formed at the inside of the end portion 54 of the second frame means 52.

The tip end portion of the first shaft portion 30 of the first frame means 36 has an end surface 120 and an annular groove 122 formed before the end surface and is adapted to be engaged into a bore 128 formed in a slide block 126 for the printed image transverse position adjustment actuation means generally designated by 124. The slide block 126 is guided by a guide rib 130 provided in the machine frame 10 to be movable along the central axis 38.

The engagement of the tip end portion of the shaft portion 30 into the bore 128 of the slide block 126 is proceeded by the first frame means 36 being elastically biased rightward in FIG. 1 relative to the second frame means 52 by the compression coil springs 112 and 114 until the end surface 120 of the shaft portion 30 abuts against an annular bottom surface of the bore 128, and when the tip end portion of the shaft portion 30 has been engaged into the bore 128 up to the predetermined insertion position, an actuator 132 mounted to the slide block 128 pushes out a pin 134 so that the pin engages in the annular groove 122 of the shaft portion 30, thereby locking the shaft portion 30 to the slide block 126 at the final insertion position.

The slide block 126 is formed with a tapped bore 136 aligned with the central axis 38. A screw member 138 engages in the tapped bore at its threaded portion. The screw member 138 has a disk portion 140 and a gear wheel portion 142, and is held at the disk portion 140 against an axial movement relative to the machine frame 10, while rotating around the central axis 38. The screw member 138 is rotated for each controlled small angle by an actuation of a step motor 145 via a gear 143 meshing with the gear wheel portion 142.

A gear wheel 144 meshes with the gear wheel member 22 of the printing drum 12 while the printing drum 12 is moved from the axial position shown in FIG. 1 leftward or rightward in the figure along the central axis 38 within a range for adjustment of a transverse position of a printed image. The gear wheel 144 is adapted to be driven to rotate by means for driving the printing drum not shown in the figure. When the printing drum 12 is within the range for adjustment of a transverse position of a printed image, the peripheral surface of the printing drum formed by the perforated sheet 20 is closely opposed by an outer circumferencial surface of a back press roller 148 adapted to rotate around its central axis 146. In printing, the inking roller 108 is moved radially outwardly of the printing drum by a radial drive mechanism not shown in the figure, so as to push a portion of the outer circumferencial wall of the printing drum made of the perforated sheet 20 radially outward toward the outer circumferencial surface of the back press roller 148, thereby applying a printed image on a print sheet introduced into a nip region 150 between the printing drum and the back press roller with its leading edge being clamped onto the outer circumferencial surface of the back press roller with an ink extruded by the inking roller 108 through perforations formed in a stencil sheet mounted around the outer circumferencial surface of the printing drum.

Such a construction of the stencil printer that the circumferencial wall of the printing drum has a flexible construction to be pushed radially outward by the inking roller 108, with the back press roller 148 having the same diameter as the printing drum being rotated in synchronization with the printing drum in a direction opposite thereto, so that the central axes of the printing drum and the back press roller are fixed relative to one another, while the pressing together and the releasing of the outer circumferencial surfaces of the printing drum and the back press roller are controlled by the pressing out and releasing thereof of the outer circumferencial surface of the printing drum by the inking roller, is described in Japanese Patent Laid-open Publication 1-204781, and further, it is described in Japanese Patent laid-open Publication 5-330224 to obtain a stencil print free of a back ink staining by fastening the leading edge of the print sheet to the back press roller.

In the above-mentioned construction, with the printing drum 12, the first frame means 36 supporting the printing drum and the second frame means 52 supporting the first frame means being set at the respective working positions shown in FIG. 1, when a transverse position of a printed image is desired to be adjusted, the step motor 145 is rotated under a control of a controller for an adjustment of a transverse position of a printed image not shown in the figure, so as to adjust an axial position of the printing drum 12 relative to a print sheet brought to the printing position as mounted on the back press roller 148 adapted to rotate at a fixed axial position relative to the machine frame 10. Then the rotation of the step motor 145 is transmitted through the gear wheel 143 and the gear portion 142 of the screw member 138, and the rotation of the screw member 138 causes a corresponding movement of the slide block 126 along the central axis 38, with the first frame means 36 being correspondingly moved relative to the second frame means 52 along the central axis 38 as slidably supported by the engagement of the shaft portions 30, 32 and 34 in the slide guide elements 58, 66 and 68, respectively, thereby moving the printing drum 12 supported by the first frame means 36 relative to the second frame means 52, and therefore relative to the machine frame 10, along the central axis 38.

When the printing operation of the printer is stopped and the printing drum is drawn out of the machine frame for changing the ink color or a maintenance, starting from the set position shown in FIG. 1, first the actuator 132 is operated so as to withdraw the pin 134 out of the annular groove 122 of the shaft portion 30. Then, by operating the levers 102 and 104, the clamps 94 and 96 are retracted from the locking engagement with the second frame means 52. Then the second frame means 52 can be moved leftward in FIG. 1 toward outside of the machine frame as guided at the opposite side edge portions by the rail members 82 and 86 via the rollers 74–80. In the meantime, in an initial stroke of the leftward movement, the first frame means 36 are moved together with the printing drum 12 rightward in the figure relative to the second frame means 52 by the action of the compression coil springs 112 and 114 until the annular end surface 116 of the gear wheel member 22 abuts against the annular rib portion 118 of the second frame means, and thereafter the first frame means 36 and the printing drum 12 are drawn out of the machine frame together with the second frame means 52 as integrally supported therein.

When such an assembly of the printing drum and the first and second frame means once drawn out of the machine frame or a different assembly of the same type charged with a different ink of a different color is mounted into the machine frame, the assembly may only be inserted into the mounting bore of the machine frame so as to be moved rightward in FIG. 1 with the rollers 74–80 provided at the opposite side edge portions of the second frame means 52 being engaged in the grooves 84 and 88 of the rail members 82 and 86. When it is assumed that the screw member 138 of the printed image transverse position adjustment actuation means 124 is positioned at the position shown in FIG. 1, a little before the second frame means 52 reach the final mounting position shown in FIG. 1, the end surface 120 of the shaft portion 30 of the first frame means 36 abuts against the bottom surface of the bore 128, and thereafter the first frame means 36 and the printing drum 12 remain in the shown position, while the second frame means 52 only are moved rightward in the figure by compressing the compression coil springs 112 and 114 until the end portion 60 of the second frame means 52 is automatically engaged by the clamps 94 and 96 by the action of the springs 98 and 100, respectively, to accomplish the final drum mounting state shown in FIG. 1. Therefore, when such a drum assembly is once drawn out of the machine frame and is again returned into the machine frame with no adjustment of the printed image transverse position adjustment actuation means 124 in the meantime, the adjustment of the printed image transverse position before the drawing out of the drum assembly is regained. When a separate drum assembly is mounted for a color change, if the respective drum assemblies are manufactured within a predetermined dimensional allowance of manufacture, the adjustment of the transverse position of a printed image is held unchanged before and after an exchange of the drum units for a color change or the like. In any event, the axial position of the first frame means 36 relative to the machine frame 10, that is the axial position of the printing drum 12 relative to the back press roller 148, is determined without intermediacy of the second frame means 52, so that the requirement for the manufacturing accuracy with regard to the final mount position of the second frame means 52 relative to the machine frame 10 depending upon the slide guide means for the withdrawal and insertion of the drum assembly extending over a distance such as about 40 cm is lessened.

Figure 3:
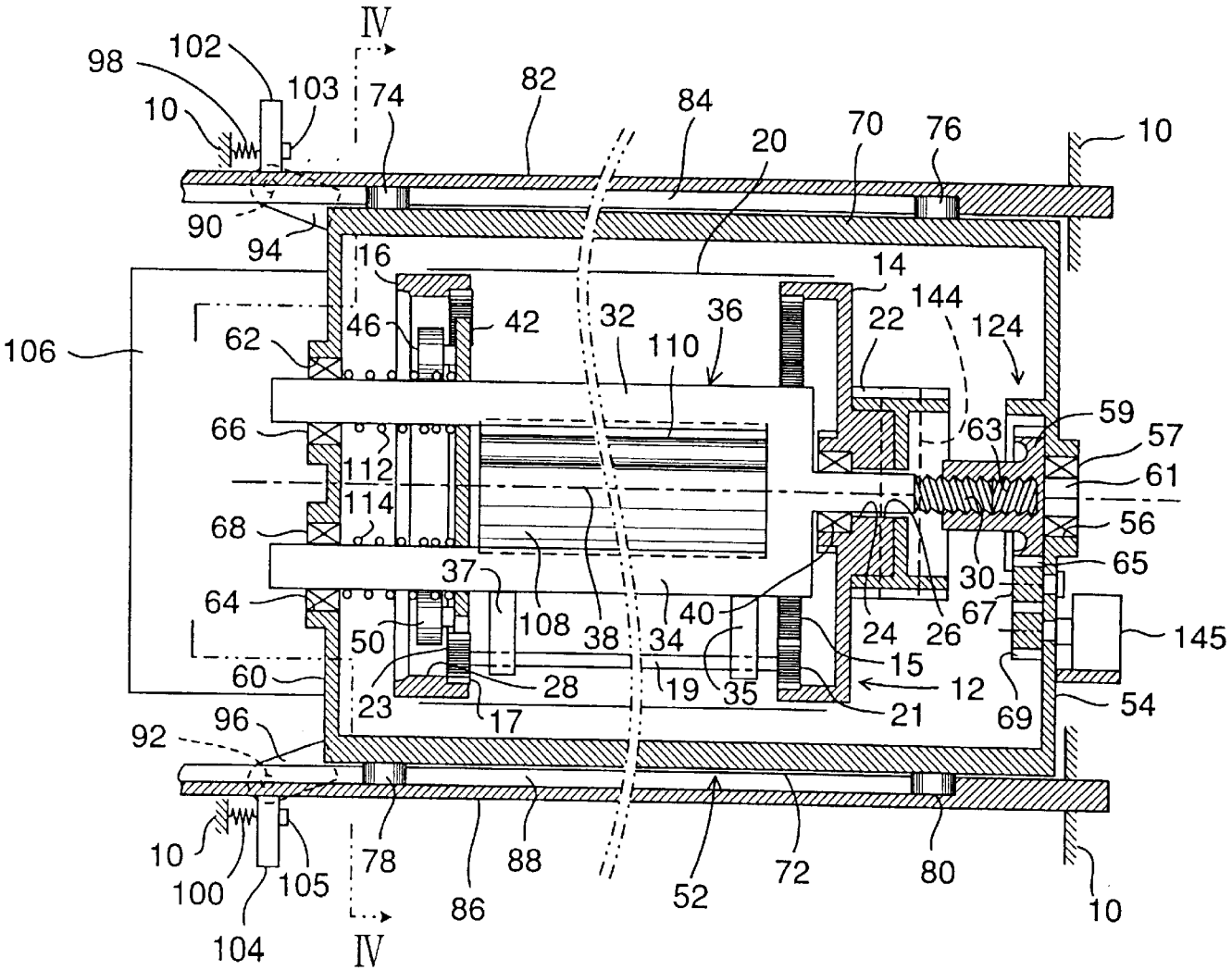
FIG. 3 is a diagrammatical plan view showing a second embodiment of the drum type printer having a mechanism for adjusting a transverse position of a printed image according to the present invention embodied as a stencil printer.
Figure 4:
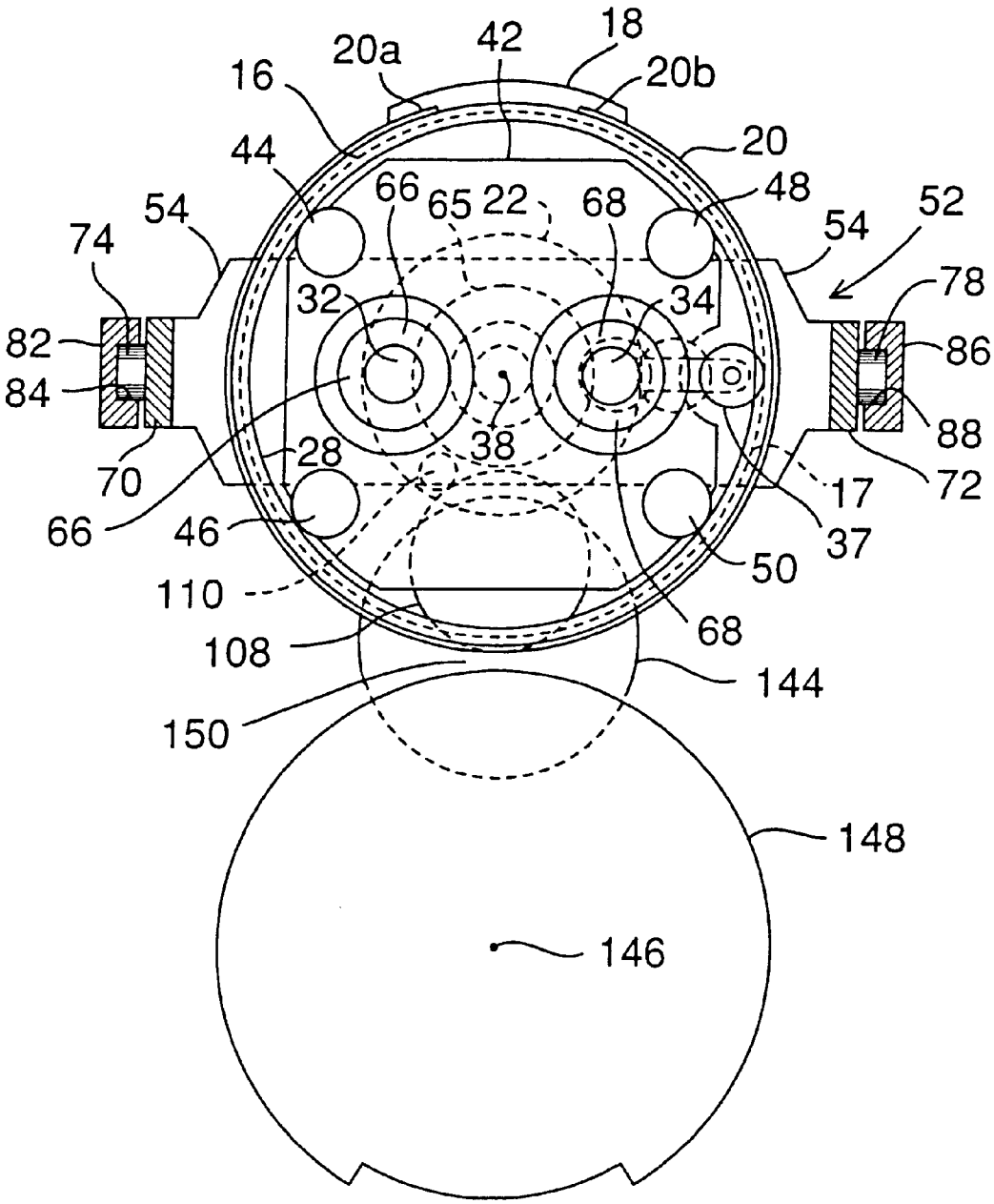
FIG. 4 is a diagrammatical sectional view of the printer of FIG. 3 taken along section IV—IV in FIG. 3.

FIG. 3 is a plan view showing diagrammatically the essential portions of a second embodiment of the drum type printer having a mechanism for adjusting a transverse position of a printed image according to the present invention, and FIG. 4 is a sectional view along section IV—IV in FIG. 3. In FIGS. 3 and 4, the portions corresponding to those shown in FIGS. 1 and 2 are designated by the same reference numerals as in FIGS. 1 and 2.

In this second embodiment, a nut member 59 is rotatably mounted with its shaft portion 61 being received in the bore 56 formed in the end portion 54 of the second frame means 52 in alignment with the central axis 38 via a bearing element 57. The nut member 59 has a tapped bore 63 aligned with the central axis 38, and the tip end of the first shaft portion 30 of the first frame means 36 is engaged therein with a thread formed therearound. The nut member 59 has a gear wheel portion 65, and a pinion 67 meshing with the gear wheel portion 65 is rotatably mounted to the end portion 54. The pinion 67 is meshed with another pinion 69 rotatably mounted to the end portion 57 and adapted to be driven by a step motor 145.

According to this construction, the transverse position of a printed image is adjusted by an adjustment of the transverse position of the first frame means 36 and the printing drum 12 supported thereby relative to the second frame means 52. Therefore, when the second frame means 52 are correctly set relative to the machine frame 10 with respect to the transverse position thereof, the adjustment of the transverse position of the printing drum 12 relative to the machine frame 10 is conducted by the printed image transverse position adjustment actuation means 124 provided only on the side of the assembly of the printing drum and the first and second frame means. Therefore, in this embodiment, the mechanism for the adjustment of the transverse position of a printed image is not affected at all by a temporal dismounting of the drum assembly out of the machine frame. The constructions of the other portions bearing the same reference numerals as in FIGS. 1 and 2 are the same as described with reference to FIGS. 1 and 2 and operate in the same manner. In this connection, the electrical connection for the pulse motor 145 may be made by an appropriate electrical connector not shown in the figure including mating elements separately mounted to the machine frame 10 and the second frame means 52. Such an electrical connector may be one such as shown in Japanese Patent Publication 62-28757.

Figure 5:
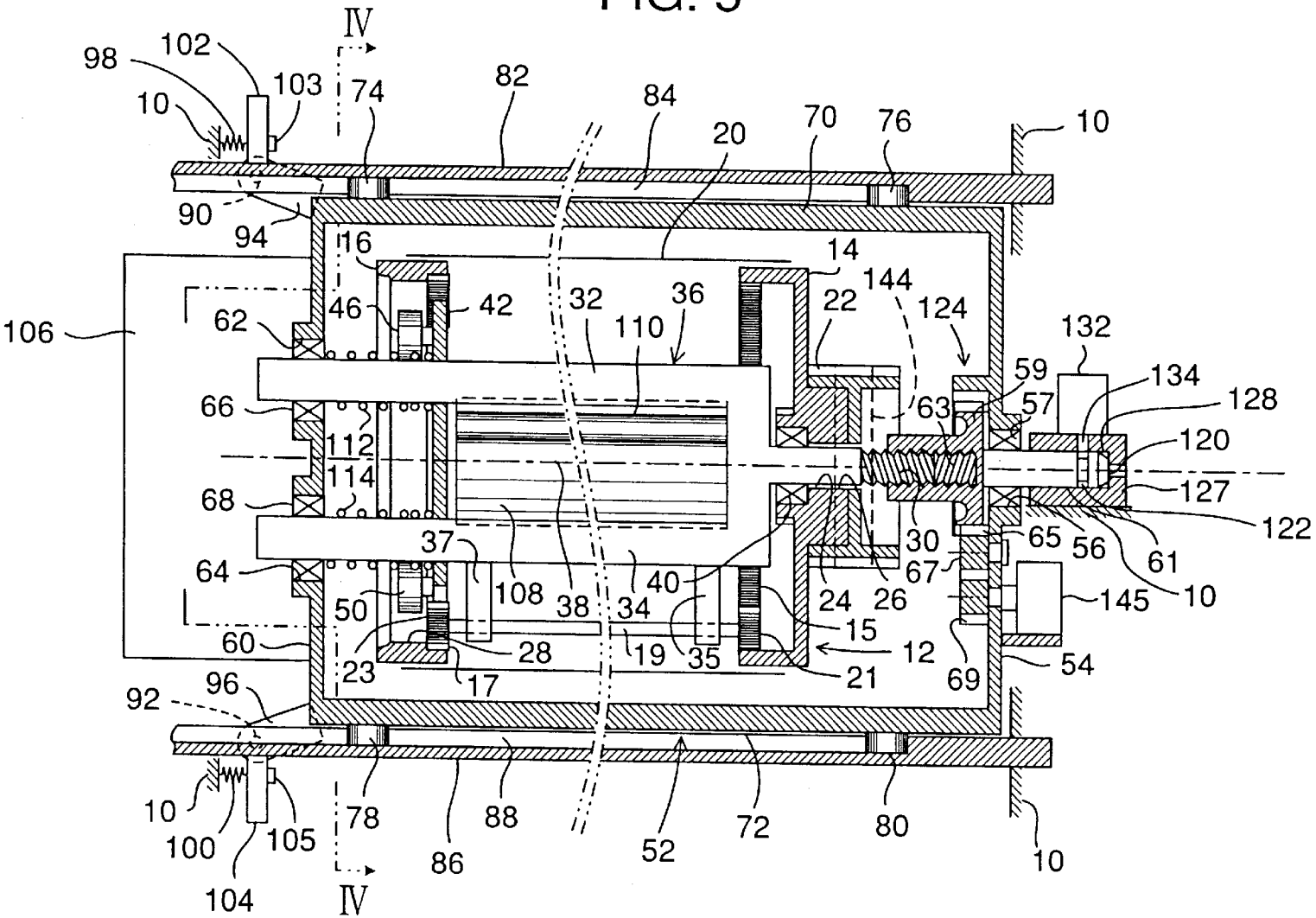
FIG. 5 is a diagrammatical plan view showing a third embodiment of the drum type printer having a mechanism for adjusting a transverse position of a printed image according to the present invention embodied as a stencil printer.

FIG. 5 is a diagrammatical plan view similar to FIGS. 1 and 3, showing a third embodiment modified principally from the second embodiment shown in FIGS. 3 and 4 but operating according to the same operation principle as the first embodiment shown in FIGS. 1 and 2. In FIG. 5, the portions corresponding to those shown in FIGS. 1 and 3 are designated by the same reference numerals as in those figures.

In this embodiment, the shaft portion 61 of the nut member 59 extends out of the bearing element 57 so as to be selectively locked at its tip portion in a bore 128 of a stationary block 127 by a pin 134 of an actuator 132 in a manner similar to the corresponding portion of the first embodiment shown in FIG. 1, except, however, that the stationary block 127 is fixed to the machine frame 10. In this case, therefore, when the drum assembly is mounted in the machine frame, the standard position for the transverse positioning of a printed image is determined based upon the nut member 59 being fixed to a predetermined position relative to the machine frame 10. Therefore, in this embodiment, the axial position of the second frame means 52 relative to the machine frame 10 at the mounting position thereof need not be so strictly set as in the second embodiment, so that the requirement for the manufacturing accuracy with regard to the final mount position of the second frame means 52 relative to the machine frame 10 depending upon the slide guide means for the withdrawal and insertion of the drum assembly extending over a distance such as about 40 cm is also lessened as in the first embodiment shown in FIGS. 1 and 2.

In this third embodiment also, the constructions of the other portions corresponding to those described in the first and second embodiments shown in FIGS. 1 and 3 by referring to the reference numerals are the same as those of the first and second embodiments and operate in the same way.

Although the present invention has been described in detail with respect to the three embodiments in the above, it will be apparent for those skilled in the art that various modifications are possible with respect to these embodiments within the scope of the present invention.

What is claimed is:

1. A drum type printer comprising:

a machine frame;

a printing drum;

a back press roller rotatably mounted in the machine frame for selectively pressing a print sheet to the printing drum;

first frame means for supporting the printing drum to be rotatable around a central axis thereof; and second frame means for supporting the first frame means to be movable along the central axis of the printing drum for at least a distance corresponding to a maximum value of an adjustment of a transverse position of a printed image;

the machine frame having means adapted to removably engage a part of the second frame means for supporting and guiding the second frame means, so as to drawably receive the second frame means, the first frame means supported by the second frame means and the printing drum supported by the first frame means; and actuation means for adjusting a transverse position of a printed image, the printed image transverse position adjustment actuation means being adapted to selectively move the first frame means relative to the machine frame when the second frame means are mounted in the machine frame.

2. A drum type printer according to claim 1, wherein the printed image transverse position adjustment actuation means are adapted to act between the first frame means and the machine frame.

3. A drum type printer according to claim 2, wherein the printed image transverse position adjustment actuation means comprise a shaft portion provided in the first frame means to extend in a direction of extension of the central axis of the printing drum, a shift block supported and guided by the machine frame to be movable along the direction of extension of the central axis of the printing drum and having a bore for selectively receiving the shaft portion of the first frame means, drive source means for selectively driving the shift block along the movable direction thereof, and means for selectively holding the shaft portion of the first frame means in the bore of the shift block when the shaft portion was inserted in the bore.

4. A drum type printer according to claim 1, wherein the printed image transverse position adjustment actuation means are adapted to act between the first frame means and the second frame means.

5. A drum type printer according to claim 1, wherein the printed image transverse position adjustment actuation means comprise a screw portion provided in the first frame means to extend in the direction of extension of the central axis of the printing drum, a nut member having a tapped bore and mounted on the second frame means to be rotatable around a central axis of the tapped bore, and drive source means for selectively rotating the nut member.

6. A drum type printer according to claim 5, wherein the nut member is stationarily positioned relative to the second frame means with respect to an axial position thereof.

7. A drum type printer according to claim 5, wherein the nut member is stationarily positioned relative to the machine frame with respect to an axial position thereof when the second frame means have been mounted in the machine frame.

8. A drum type printer according to claim 1, wherein the printing drum has a bearing bore aligned with the central axis thereof at a first end thereof and an annular track along an inner periphery of a second end thereof opposite to the first end thereof, the first frame means have a first shaft portion at a first end thereof, the first shaft portion extending along the central axis of the printing drum while engaging the bearing bore of the printing drum therethrough so as to rotatably support the first end of the printing drum, second and third shaft portions at a second end thereof opposite to the first end thereof, the second and third shaft portions extending in parallel with the central axis of the printing drum, and at least three rollers engaging the annular track for rotatably supporting the second end of the printing drum, and the second frame means have a first slide guide bore at a first end thereof for receiving the first shaft portion of the first frame means to be slidable along the central axis of the printing drum, and second and third slide guide bores at a second end thereof opposite to the first end thereof for receiving the second and the third shaft portions of the first frame means, respectively, to be slidable in parallel with the central axis of the printing drum.

9. A drum type printer according to claim 8, wherein the first frame means are elastically biased by spring means relative to the second frame means in a direction of moving from the second end to the first end of the second frame means, and the printed image transverse position adjustment actuation means include means for acting at the first shaft portion of the first frame means so as to restrict an axial movement of the first frame means biased by the spring means.

* * * * *